US010632503B2

(12) United States Patent
Wilczek et al.

(10) Patent No.: US 10,632,503 B2
(45) Date of Patent: Apr. 28, 2020

(54) CLASSIFYING DEVICE FOR CLASSIFYING A GRANULAR MATERIAL FLOW

(71) Applicants: ThyssenKrupp Industrial Solutions AG, Essen (DE); ThyssenKrupp AG, Essen (DE)

(72) Inventors: Michael Wilczek, Warendorf (DE); Olaf Hagemeier, Beckum (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 371 days.

(21) Appl. No.: 15/521,377

(22) PCT Filed: Oct. 12, 2015

(86) PCT No.: PCT/EP2015/073565

§ 371 (c)(1),
(2) Date: Apr. 24, 2017

(87) PCT Pub. No.: WO2016/062571

PCT Pub. Date: Apr. 28, 2016

(65) Prior Publication Data

US 2017/0304869 A1 Oct. 26, 2017

(30) Foreign Application Priority Data

Oct. 22, 2014 (DE) ..... 10 2014 015 550

(51) Int. Cl.

| | |
|---|---|
| ***B07B 9/02*** | (2006.01) |
| ***B02C 23/14*** | (2006.01) |
| ***B07B 4/02*** | (2006.01) |
| ***B07B 11/06*** | (2006.01) |
| ***B07B 1/22*** | (2006.01) |

(Continued)

(52) U.S. Cl.

CPC ..... *B07B 9/02* (2013.01); *B02C 23/14* (2013.01); *B07B 1/22* (2013.01); *B07B 4/02* (2013.01);

(Continued)

(58) Field of Classification Search

CPC .... B07B 1/22; B07B 4/02; B07B 4/08; B07B 7/086; B07B 9/00; B07B 9/02;

(Continued)

(56) References Cited

U.S. PATENT DOCUMENTS

2010/0038461 A1 2/2010 Neumann
2014/0306044 A1* 10/2014 Guenter ..... B07B 4/04 241/42

(Continued)

FOREIGN PATENT DOCUMENTS

CN 102319673 A 1/2012
CN 102615046 A 8/2012

(Continued)

OTHER PUBLICATIONS

English translation International Search Report issued in PCT/EP2015/073565 dated Jan. 5, 2016 (dated Jan. 14, 2016).

(Continued)

*Primary Examiner* — Charles A Fox
*Assistant Examiner* — Kalyanavenkateshware Kumar
(74) *Attorney, Agent, or Firm* — thyssenkrupp North America, Inc.

(57) ABSTRACT

A classifying device may be used to classify a granular material flow. The classifying device may comprise a first inlet that allows a first material flow into the classifying device, a second inlet that allows a second material flow into the classifying device, a static classifier, and a dynamic classifier. The static classifier may be positioned such that the static classifier at least partially surrounds the dynamic classifier. The classifying device may comprise a distributing device that is designed in such a manner that it supplies the material flow of the first inlet to the static classifier and the material flow of the second inlet to the dynamic classifier.

10 Claims, 3 Drawing Sheets

(51) Int. Cl.
*B07B 7/083* (2006.01)
*B07B 7/086* (2006.01)

(52) U.S. Cl.
CPC ..... *B07B 7/083* (2013.01); *B07B 11/06* (2013.01); *B07B 7/086* (2013.01)

(58) Field of Classification Search
CPC ..... B07B 11/06; B02C 23/02; B02C 23/08; B02C 23/10; B02C 23/14
See application file for complete search history.

(56) References Cited

U.S. PATENT DOCUMENTS

| | | | | |
|---|---|---|---|---|
| 2015/0060582 | A1* | 3/2015 | Truce | B02C 23/12 241/38 |
| 2016/0001327 | A1* | 1/2016 | Hagemeier | B07B 7/083 241/101.5 |

FOREIGN PATENT DOCUMENTS

| | | | | |
|---|---|---|---|---|
| CN | 203556562 | U | 4/2014 | |
| CN | 104039466 | A | 9/2014 | |
| DE | 1607536 | A1 | 10/1971 | |
| DE | 102004027128 | * | 12/2005 | B07B 9/02 |
| DE | 102004027128 | A | 12/2005 | |
| DE | 102006039775 | A | 2/2008 | |
| DE | 102011055762 | A | 5/2013 | |

OTHER PUBLICATIONS

English language abstract of DE 102006039775.
English language machine translation for DE 1607536 A1.

* cited by examiner

CLASSIFYING DEVICE FOR CLASSIFYING A GRANULAR MATERIAL FLOW

CROSS REFERENCE TO RELATED APPLICATIONS

This application is a U.S. National Stage Entry of International Patent Application Serial Number PCT/EP2015/073565, filed Oct. 12, 2015, which claims priority to German Patent Application No. DE 10 2014 015 550.1 filed Oct. 22, 2014, the entire contents of both of which are incorporated herein by reference.

FIELD

The present disclosure generally relates to classifying devices, including classifying devices for classifying granular material flows.

BACKGROUND

It is known to divide granular material, such as, for example, cement, cement-containing materials, slag, limestone or else ores, into a coarse and a fine grain fraction by means of a classifier. Such classifiers are customarily placed downstream of a material comminuting apparatus, such as, for example, a roller mill, wherein the coarse material emerging from the classifier is supplied again to the material comminuting apparatus. Known classifiers are, for example, static classifiers in which material is roughly classified via impacting and guiding apparatuses, and dynamic classifiers in which material is finely classified, for example, via a rotating rod basket.

DE 10 2004 027 128 A1 discloses a classifying device which comprises a static classifier and a dynamic classifier, wherein the static classifier forms the first classifying stage and the dynamic classifier forms the second classifying stage.

During the comminuting of material and in particular in cement production, a plurality of grinding operations using different comminuting apparatuses are frequently necessary in order to achieve the desired grain size. A classifying device is customarily connected downstream of each of said comminuting apparatuses.

DETAILED DESCRIPTION

Figure 1:
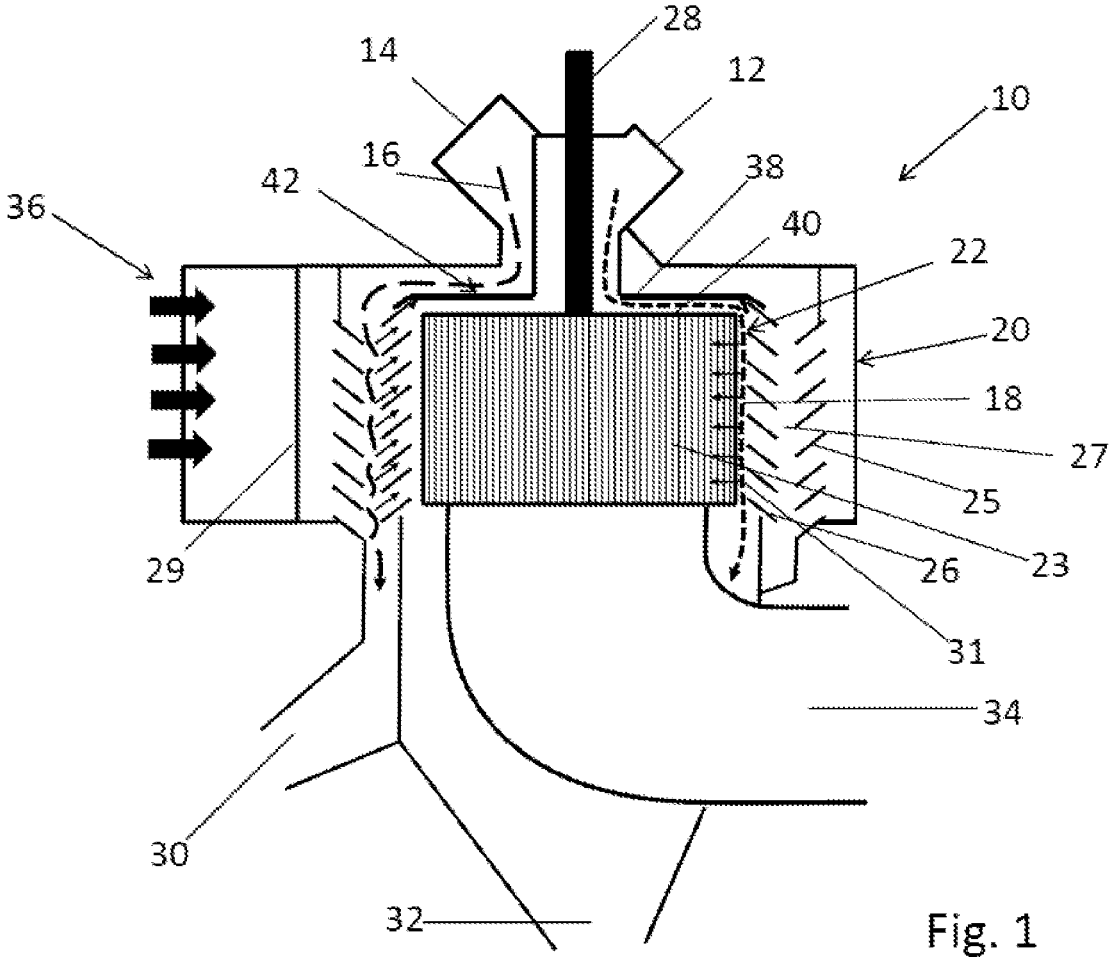
FIG. 1 is a schematic sectional view of an example classifying device with an example distributing device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Proceeding therefrom, one example object of the present disclosure is to provide a classifying device with a compact construction that permits efficient classifying of material and a reduction in the number of components of a grinding plant.

A classifying device for classifying a granular material flow comprises, according to a first aspect of the invention, a first inlet for letting a first material flow into the classifying device, and a second inlet for letting a second material flow into the classifying device. Furthermore, the classifying device comprises a static classifier and a dynamic classifier, wherein the static classifier is arranged in such a manner that it at least partially surrounds the dynamic classifier. Furthermore, the classifying device comprises a distributing device which is designed in such a manner that it supplies the material flow of the first inlet to the static classifier and supplies the material flow of the second inlet to the dynamic classifier.

Such a distributing device affords the advantage that at least two material flows of different grain sizes can be supplied to the classifying device, wherein the material flow entering through the first inlet flows through the static classifier and the dynamic classifier, and the material flow entering the classifying device through the second inlet flows exclusively through the dynamic classifier. The classifying device preferably comprises one or more first and second inlets via which the material to be classified enters the classifying device.

The material flow entering through the first inlet is, for example, a material which is coarse-grained relative to the material flow entering the classifying device through the second inlet. Said coarse-grained material can originate, for example, from a roller mill or a stock bed roller mill. The material flow entering the classifying device through the second inlet can be, for example, a material which is comminuted by means of a ball mill.

The described classifying device firstly permits omission of an additional classifying device for each of the material flows and secondly permits the two material flows to be classified by means of a single classifying device.

The granular material flow can be, in particular, crude cement material, cement, cement-containing materials, limestone, slag or ore.

The material flow entering the classifying device through the first inlet is supplied to the static classifier via the distributing device. A static classifier comprises a plurality of flow devices, for example guide vanes, which serve to deagglomerate the material flow flowing through the static classifier. The static classifier is designed in particular in such a manner that it forms a cylindrical ring-shaped classifying zone between the flow devices, and the dynamic classifier is arranged within the static classifier. The static classifier is supplied via a classifying air duct, for example by means of a fan, with classifying air which is conducted via the plurality of guide vanes of the flow device counter to the material flow flowing through the static classifier.

The coarser grain fraction of the material flow flowing into the classifying device through the first inlet leaves the static classifier through a first outlet, wherein the finer grain fraction of the material flow is conducted to the dynamic classifier by the classifying air.

A dynamic classifier comprises a moving classifying zone, for example a rotatable rod basket, into which a material flow with a small grain size, in particular of up to approximately 10 mm, enters. The dynamic classifier is arranged, for example, coaxially with respect to the static classifier and rotationally symmetrically with respect to the drive axis of the moving classifying zone. The material flow of average grain size is rejected by the dynamic classifier and emerges out of the classifying device from a second outlet. The material flow passing through the dynamic classifier displays a grain size of up to approximately 300 μm and emerges from the classifying device out of a third outlet.

The material flow entering the classifying device through the second inlet is supplied to the dynamic classifier via the distributing device, wherein the material rejected by the dynamic classifier leaves the classifying device through the second outlet and the material passing into the moving classifying zone of the dynamic classifier emerges from the classifying device through the third outlet.

The classifying device according to the invention permits division of two material flows of different grain sizes into three grain fractions. The coarse grain fraction classified in the static classifier can be supplied to a first comminuting apparatus, such as, for example, a roller mill, with the average grain size classified in the dynamic classifier being able to be supplied to a second comminuting apparatus, such as, for example, a ball mill. A particularly compact construction of a classifying device with a static and a dynamic classifier is thereby achieved.

The grain sizes of the coarse material flow entering the classifying device through the first inlet are up to approximately 100 mm. The grain sizes of the fine material flow entering the classifying device through the second inlet are up to approximately 10 mm.

According to a first embodiment, the distributing device comprises at least one rotatable disk. The at least one rotatable disk is connected, for example, to a driveshaft and is driven to rotate. The driveshaft can be, for example, the drive spindle of the movable classifying zone of the dynamic classifier. The striking of the material flow entering the classifying device against a rotating disk ensures that the granular material is deagglomerated. Furthermore, the material is moved radially outward by the rotation of the disk and is therefore uniformly distributed over the classifying zone of the static classifier and/or of the dynamic classifier.

The at least one rotatable disk is arranged, for example, for supplying the material flow of the first inlet to the static classifier or for supplying the material flow of the second inlet to the dynamic classifier.

In a further embodiment, the distributing device comprises at least one region which is connected to the housing of the classifying device. That region of the distributing device which is connected to the housing is preferably not rotatable and is arranged for supplying the material flow of the first inlet to the static classifier or for supplying the material flow of the second inlet to the dynamic classifier.

According to a further embodiment, the distributing device comprises a first rotatable disk for supplying the material flow of the first inlet to the static classifier and a second rotatable disk for supplying the material flow of the second inlet to the dynamic classifier. As a result, deagglomeration of the first and of the second material flow is ensured before said material flows are conducted to the static or the dynamic classifier.

According to a further embodiment, the at least one rotatable disk is connected to a driveshaft. The first disk and the second disk are arranged, for example, rotationally symmetrically about the driveshaft, wherein the driveshaft is, for example, the driveshaft of the movable classifying zone of the dynamic classifier. The use of such a driveshaft for driving at least one rotatable disk of the distributing device permits a particularly space-saving, compact construction of the classifying device.

According to a further embodiment, at least one out of the first disk and the second disk is a ring-shaped disk. The other out of the first and the second disk is designed, for example, as a circular disk. A ring-shaped design of one of the disks permits a parallel arrangement of the disks, wherein, for example, the first disk for supplying the material flow to the static classifier is arranged above the second disk, and therefore the material flow entering through the first inlet drops through the second upper disk onto the first disk. This permits a particularly compact construction of the distributing device. Furthermore, it is thereby possible to form the inlets in a particularly space-saving manner, for example concentrically, and at the same time to achieve reliable distribution of the material flows between the static and the dynamic classifier.

According to a further embodiment, the first disk and the second disk are connected to each other via connecting means. A simple drive of the two disks via a driveshaft is realized by the first and second disk being connected.

According to a further embodiment, at least one out of the first disk and the second disk of the distributing device comprises a plurality of guiding elements on the surface of the disk. Such guiding elements ensure that the material is deagglomerated when it strikes against the surface of the disks and, furthermore, that the material is reliably conducted toward the static or the dynamic classifier. Furthermore, means for deagglomerating the material are preferably arranged on the surface of at least one out of the first and second disk, said means bringing about, for example, a rough, granular surface structure of the disks.

According to a further embodiment, the guiding elements are of rod-shaped design and extend radially outward.

According to a further embodiment, the guiding elements comprise the connecting means between the first disk and the second disk.

For the connection of the first and the second disk, the guiding elements according to a further embodiment are of plate-like design and are arranged, for example, orthogonally to the disks. This permits a simple connection of the first and the second disk with simultaneous use of the connecting means as guiding elements for guiding the material flow.

A grinding plant for comminuting grinding stock comprises at least one grinding apparatus and a classifying device which is connected to the at least one grinding apparatus and is intended for classifying the grinding stock, as described above.

The at least one grinding apparatus comprises, for example, a roller mill or a ball mill, wherein the first outlet and the second outlet of the classifying device are connected to an inlet of the grinding apparatus. The outlet of the grinding apparatus is preferably connected to the second inlet of the classifying device.

The grinding plant preferably comprises a roller mill and a ball mill, wherein the roller mill is connected to the first inlet of the classifying device and the second outlet of the classifying device is connected to the ball mill. Fresh stock fed into the grinding plant is guided into the first inlet of the classifying device. The coarse grinding stock emerging from the first outlet of the classifying device is supplied to the roller mill, wherein the grit stock of average grain size emerging from the second outlet of the classifying device is supplied to the ball mill. The fine finished stock emerging from the third outlet of the classifying device is guided out of the grinding plant, for example via a separator in which the mixture of air and grinding stock is separated into grinding stock and air.

An above-described grinding plant with a classifying device of the above-described type comprises a small number of components, such as, for example, lines between a plurality of classifying devices and a plurality of grinding devices. The grinding stock flows of one or more grinding apparatuses are classified with a classifying device which divides the grinding stock flow into three different grain sizes and therefore permits grinding stock with an optimum grain size to be supplied to a corresponding grinding apparatus. An efficient and cost-effective grinding operation is therefore achieved. Furthermore, the maintenance intensity of the grinding plant is reduced because of the reduced number of components.

FIG. 1 shows a classifying device 10 with a static classifier 20 and a dynamic classifier 22. In the exemplary embodiment from FIG. 1, the static classifier 20 is arranged around the dynamic classifier 22 and is of cylindrical ring-shaped design. Furthermore, the static classifier comprises an outer cylindrical wall 29 and, arranged radially inwardly with respect thereto, a first outer static flow device 25 and a second inner static flow device 26. The first and second flow devices 25, 26 each comprise parallel guide vanes, wherein the guide vanes of the first flow device 25 are positioned in a radially dropping manner. The guide vanes of the second flow device 26 are positioned in an opposed manner with respect to the guide vanes of the first flow device 26. A cylindrical static classifying zone 27 is formed between the first and the second flow device 25, 26.

Within the static classifier 20, the dynamic classifier 22 is arranged radially inward of the second flow device 26. The dynamic classifier 22 comprises a rod basket 23 with rods running in the axial direction. The rod basket 23 is driven in a rotating manner via a driveshaft 28 attached to the upper end of the rod basket. In the exemplary embodiment in FIG. 1, the dynamic classifier 22 is arranged coaxially with respect to the static classifier 20 and rotationally symmetrically with respect to the drive spindle 28. The dynamic classifying zone 31 is formed between the classifying basket and the second flow device 26. Furthermore, vertical rod-shaped guiding elements (not illustrated in FIG. 1) which are attached to the flow device 25 can be arranged in the dynamic classifying zone 31.

A distributing device 42 which comprises a first disk 38 and a parallel second disk 40 is arranged at the upper end of the rod basket 23. The second disk 40 is of the same diameter as the rod basket 23, is fixedly connected to the latter and forms a cover of the cylindrical rod basket 23. The first disk 38 is arranged parallel to the second disk 40 and above the latter and is of ring-shaped design, with a recess in the center. A passage is formed between the first disk 38 and the second disk 40. The first disk 38 and the second disk 40 are connected to each other in a manner not illustrated in FIG. 1, and therefore rotation of the second disk 40 which is fixedly connected to the rod basket 23 brings about rotation of the first disk 38.

A first inlet 14 and a second inlet 12 for letting a material flow into the classifying device are arranged above the distributing device 42. In the exemplary embodiment according to FIG. 1, the inlets 12, 14 comprise concentric openings which are arranged around the driveshaft 28 and comprise inlets depicted in a tubular manner, wherein the inlet opening of the first inlet 14 is arranged above the inlet opening of the second inlet 12. The driveshaft 28 of the dynamic classifier 22 extends centrally in the axial direction through the second inlet 14.

A classifying air duct 36 is arranged around the static classifier 20. In the exemplary embodiment illustrated in FIG. 1, the classifying air duct 36 is schematically illustrated laterally, on the left side of the static classifier 20. The classifying air duct 36 is fluidically connected to the static classifier, and therefore classifying air can flow from the outer wall 29 of the static classifier 20 through the outer static flow device 25 into the classifying zone 27 of the static classifier 20. The flow direction of the classifying air is illustrated in FIG. 1 by the arrow direction in the classifying air duct 36.

FIG. 1 furthermore shows three outlets 30, 32, 34 for letting the classified material flow out of the classifying device 10. The first outlet 30 comprises a duct which is arranged below the static classifying zone 27 in such a manner that the material rejected in the static classifying zone drops into the duct and emerges out of the classifying device 10 through the outlet 30. The second outlet 32 comprises a duct which is arranged below the dynamic classifying zone 31 in such a manner that the material rejected by the dynamic classifier drops into the duct and emerges out of the classifying device 10 through the outlet 32. The third outlet 34 comprises a duct which is arranged below the rod basket 23 and through which the material which has passed through the static and the dynamic classifying stages 27, 31 emerges from the classifying device 10 together with the classifying air within the rod basket 23.

During the operation of the classifying device 10, a coarse material flow flows in the arrow direction 16 through the first inlet 14 onto the first disk 38 which is driven in a rotating manner via the drive spindle 28. Rotation of the first disk 38 causes the material to move radially outward on the disk 38 and to pass from above into the static classifier 20 and into the static classifying zone 27. The impact of the material flow against the disk 38 and the rotation of the disk 38 additionally ensure that the material is deagglomerated.

From the outer wall 29 of the static classifier 20, classifying air enters the static classifier 20 and flows through the outer flow device 25 counter to the material flow flowing through the static classifying zone 27. In the static classifying zone 27, the material flow is deflected radially inward toward the inner flow device 26 by the entering classifying air. The coarse material flows through the static classifying stage 27 and drops downward toward the first outlet 30. The finer material is blown by the classifying air through the inner flow device 26 into the dynamic classifying zone 31. In the dynamic classifying zone 31, the coarse material drops downward toward the second outlet 32 and the finer material passes through the rods of the rod basket 23 into the interior of the rod basket. The finer material in the interior of the rod basket 23 drops downward toward the third outlet 34.

The classifying device 10 comprises three outlets 30, 32, 34 for three different grain fractions of the material flow. The material flow flowing into the classifying device 10 through the first inlet 14 is classified into three different grain fractions which leave the classifying device 10 through three different outlets 30, 32, 34.

The material flow entering the classifying device 10 through the second inlet 12 runs through the classifying device in the arrow direction 18 and first of all flows onto the second disk 40 which is driven to rotate by the drive spindle.

The material is moved radially outward by the rotation of the disk 40 and enters the dynamic classifying zone 31 adjoining the second disk 40 in the dynamic classifier 22. As already described with respect to the material flow flowing into the classifying device 10 through the first inlet 14, the coarser material drops downward through the dynamic classifying zone to the second outlet 32. It is conceivable to subsequently at least partially combine the material emerging through the outlet 30 and the material emerging through the outlet 32 and to supply them to a grinding device.

The finer material enters the rod basket 23 and is discharged downward together with the classifying air in the direction of the third outlet 34. It is likewise conceivable to allow the material which has passed through the rod basket 23 to emerge out of the classifying device 10 above the dynamic classifier 22, wherein the outlet 34 is arranged above the rod basket in a manner not illustrated in FIG. 1.

The material entering the classifying device through the second inlet 12 is classified into two grain sizes, wherein the finer material is let out of the classifying device through the third outlet 34 and the coarser material through the second outlet 32.

The classifying device 10 enables two material flows of different grain sizes to be fed into the classifying device, wherein the first material flow is supplied both to the static classifier 20 and to the dynamic classifier 22 and the second material flow is supplied exclusively to the dynamic classifier 22. This permits a coarse material flow from, for example, a roller mill to be let into the classifying device 10 through the first inlet 14, and a finer material flow from, for example, a ball mill, to be let into same through the second inlet 12.

The described classifying device 10 permits a considerable space saving since one classifying device is used for two material flows, and an additional classifier can be dispensed with.

Figure 2:
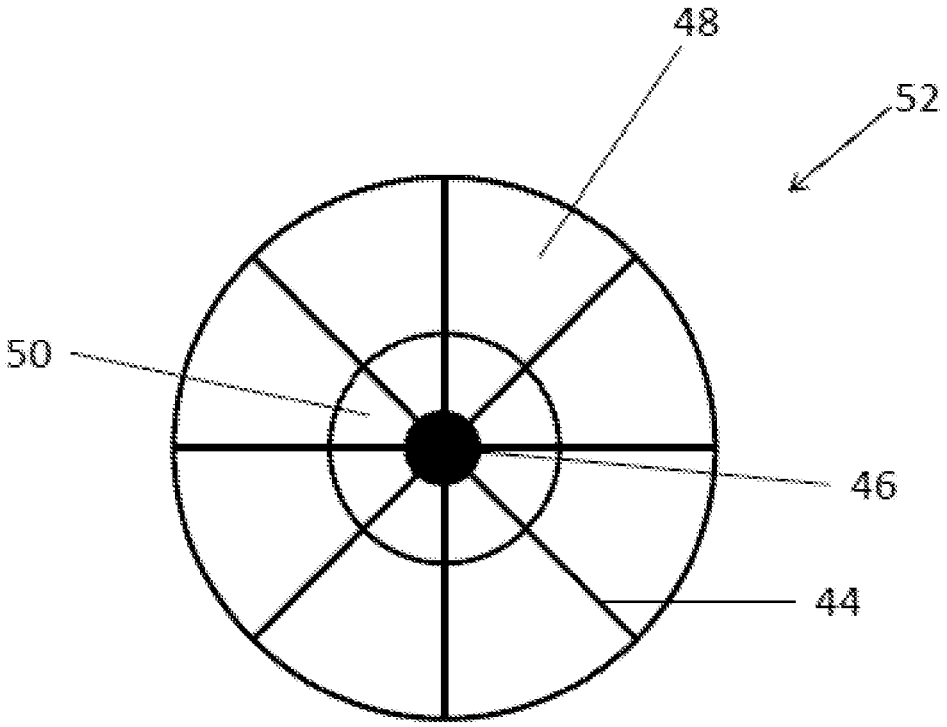
FIG. 2 is a schematic top view of another example distributing device.

FIG. 2 shows a top view of a distributing device 52 according to an exemplary embodiment. The construction of the distributing device 52 corresponds to the construction of the distributing device 42 described with respect to FIG. 1, wherein the distributing device 52 comprises two disks, a first disk 48 and a second disk 50, which are arranged parallel to each other, wherein the first disk 48 is arranged above the second disk 50. In addition to the distributing device 42 from FIG. 1, the distributing device 52 in the exemplary embodiment from FIG. 2 comprises guiding elements 44 on the first disk 48 and on the second disk 50. The guiding elements comprise elongate struts which are attached on the upper side of the disks 48, 50 and extend in a star-shaped manner in the radial direction. Overall, in the exemplary embodiment in FIG. 2, each disk 48, 50 comprises eight such guiding elements 44.

During the operation of the classifying device 10, the guiding elements 44 attached to the disks 48, 50 ensure that the material flow is conducted radially outward. In addition, the guiding elements 44 provide an impact surface for the material flow and ensure deagglomeration of the material flow when the latter enters the static classifier 20 and/or the dynamic classifier 22.

Figure 3:
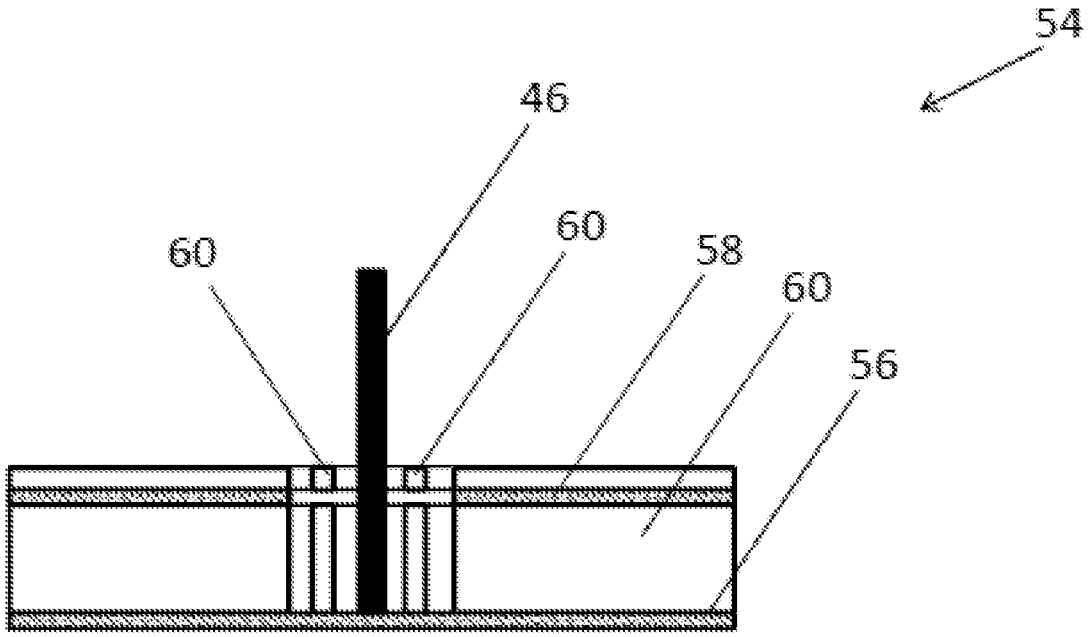
FIG. 3 is a schematic sectional view of still another example distributing device.

FIG. 3 shows a sectional illustration of the distributing device 54 according to a further exemplary embodiment, wherein the construction of the distributing device 54 substantially corresponds to the construction of the distributing device 52 described with respect to FIG. 2, with the difference that the guiding elements 60 are of plate-like design and extend from the first disk 56 to the second disk 58 and through the latter. The guiding elements 60 from FIG. 3 therefore ensure a simple connection of the first disk 56 to the second disk 58 in addition to the advantages of the guiding elements 44 described with respect to FIG. 2.

LIST OF REFERENCE SIGNS

10 Classifying device
12 Second inlet
14 First inlet
16 Material flow
18 Material flow
20 Static classifier
22 Dynamic classifier
23 Rod basket
25 Outer static flow device
26 Inner static flow device
27 Static classifying zone
28 Drive spindle
29 Outer wall
30 First outlet
31 Dynamic classifying zone
32 Second outlet
34 Third outlet
36 Classifying air duct
38 First disk
40 Second disk
42 Distributing device
44 Guiding element
46 Drive spindle
48 First disk
50 Second disk
52 Distributing device
54 Distributing device
56 First disk
58 Second disk
60 Guiding elements

What is claimed is:

1. A classifying device for classifying a granular material flow, the classifying device comprising:
- a first inlet for allowing a first material flow into the classifying device;
- a second inlet for allowing a second material flow into the classifying device;
- a static classifier;
- a dynamic classifier, wherein the static classifier is positioned such that the static classifier at least partially surrounds the dynamic classifier; and
- a distributing device that is configured to supply the first material flow from the first inlet to the static classifier and to supply the second material flow from the second inlet to the dynamic classifier, wherein the distributing device comprises:
- a first rotatable disk for supplying the first material flow from the first inlet to the static classifier; and
- a second rotatable disk for supplying the second material flow from the second inlet to the dynamic classifier.

2. The classifying device of claim 1 wherein the distributing device comprises at least one region that is connected to a housing of the classifying device.

3. The classifying device of claim 1 wherein at least one of the rotatable disks is connected to a driveshaft.

4. The classifying device of claim 1 wherein at least one of the rotatable disks is a ring-shaped disk.

5. The classifying device of claim 1 further comprising connecting means that connects the first and second rotatable disks.

6. The classifying device of claim 1 wherein at least one of the rotatable disks comprises a plurality of guiding elements on a surface.

7. The classifying device of claim 6 wherein the plurality of guiding elements are rod-shaped and extend radially outward.

8. The classifying device of claim 6 wherein the plurality of guiding elements comprise a connecting means that connects the first and second rotatable disks.

9. The classifying device of claim 6 wherein the plurality of guiding elements are of plate-like design.

10. A grinding plate for comminuting granular material, the grinding plate comprising:

at least one grinding apparatus; and a classifying device that is connected to the at least one grinding apparatus, wherein the classifying device comprises:

a first inlet for allowing a first material flow into the classifying device, a second inlet for allowing a second material flow into the classifying device, a static classifier, a dynamic classifier, wherein the static classifier is positioned such that the static classifier at least partially surrounds the dynamic classifier, and a distributing device that is configured to supply the first material flow from the first inlet to the static classifier and to supply the second material flow from the second inlet to the dynamic classifier, wherein the distributing device comprises:

a first rotatable disk for supplying the first material flow from the first inlet to the static classifier; and a second rotatable disk for supplying the second material flow from the second inlet to the dynamic classifier.

* * * * *